US005446010A

United States Patent [19]

Toyofuku et al.

[11] Patent Number: 5,446,010

[45] Date of Patent: * Aug. 29, 1995

[54] THERMOSENSITIVE RECORDING MATERIAL

[75] Inventors: Kunitaka Toyofuku, Sakura; Akiko Iwasaki, Urawa, both of Japan

[73] Assignee: New Oji Paper Co., Ltd., Tokyo, Japan

[ * ] Notice: The portion of the term of this patent subsequent to Mar. 8, 2011 has been disclaimed.

[21] Appl. No.: 229,332

[22] Filed: Apr. 12, 1994

[30] Foreign Application Priority Data

Apr. 14, 1993 [JP] Japan ..... 5-109796

[51] Int. Cl.[6] ..... B41M 5/30

[52] U.S. Cl. ..... 503/208; 503/209; 503/216; 503/225

[58] Field of Search ..... 427/150; 503/208, 209, 503/216, 225

[56] References Cited

U.S. PATENT DOCUMENTS

| | | | |
|---|---|---|---|
| 3,539,375 | 11/1970 | Baum . | |
| 5,292,711 | 3/1994 | Nishimura et al. | 503/209 |
| 5,314,859 | 5/1994 | Takahashi et al. | 503/207 |

FOREIGN PATENT DOCUMENTS

| | | | |
|---|---|---|---|
| 43-4160 | 2/1943 | Japan | 503/209 |
| 45-14039 | 5/1970 | Japan | 503/209 |
| 48-27736 | 4/1973 | Japan | 503/209 |
| 56-146794 | 11/1981 | Japan | 503/209 |
| 58-104793 | 6/1983 | Japan | 503/209 |
| 58-199189 | 11/1983 | Japan | 503/209 |
| 59-93387 | 5/1984 | Japan | 503/209 |
| 59-114096 | 6/1984 | Japan | 503/209 |
| 59-167292 | 9/1984 | Japan | 503/209 |
| 60-21075 | 5/1985 | Japan | 503/209 |
| 60-78782 | 5/1985 | Japan | 503/209 |
| 62-164579 | 7/1987 | Japan | 503/209 |

*Primary Examiner*—B. Hamilton Hess

*Attorney, Agent, or Firm*—Armstrong, Westerman, Hattori, McLeland & Naughton

[57] ABSTRACT

A thermosensitive recording material having a high thermosensitivity and useful for recording thereon colored images having high storage persistency, comprises a thermosensitive colored image-forming layer formed on a surface of a substrate sheet and comprising a colorless dye precursor; a color-developing aromatic compound having, per molecule thereof, at least one arylsulfonylureido group of the formula (I):

$$R^1-SO_2NHC(=O)NH- \quad (I)$$

wherein $R^1$=aromatic group unsubstituted or substituted with at least one of lower alkyl and lower alkoxyl group and hologen atoms; a sensitizing aromatic amide compound of the formula (II):

$$Ar^1-C(=O)NH-Ar^2 \quad (II)$$

wherein $Ar^1$, $Ar^2$=non-substituted phenyl or naphthyl group or substituted phenyl or naphthyl group with 1 to 3 substituent selected from aryl, aryloxy, aralkyl, alkyl, alkoxyl, trihalogenomethyl, nitro and alkylamino groups and halogen atoms; and a binder.

7 Claims, No Drawings

THERMOSENSITIVE RECORDING MATERIAL

BACKGROUND OF THE INVENTION

1. Field of the Invention

The present invention relates to a thermosensitive recording material on which colored images are formed by heating. More particularly, the present invention relates to a thermosensitive recording material capable of forming thereon colored images resistant to fading and thus exhibiting a high degree of persistency during extended storage thereof.

The thermosensitive recording material of the present invention is capable of recording thereon colored images exhibiting an excellent resistance to water, oily and fatty substances, and plasticizers, and thus has superior persistency when stored over a long period of time and therefore is useful as colored image-recording sheets, sheets for use in facsimiles, word processors, CRT image printers and cash dispensers, as passenger tickets, commuter passes, labels such as POS labels, cards such as prepaid cards, and as transit passes.

2. Description of the Related Arts

It is known that a conventional thermosensitive recording material comprises a supporting substrate, for example, a paper sheet, synthetic paper sheet, or plastic resin film and a thermosensitive colored image-forming layer formed on a surface of the supporting substrate and comprising an electron-donative dye precursor, for example, a leuco basic dye, an electron-acceptive color-developing agent consisting of an organic acid substance, for example, a phenolic compound, and a binder. When the thermosensitive colored image-forming layer is heated imagewise, colored images are recorded thereon by a reaction of the dye precursor with the color-developing agent.

This type of thermosensitive recording material is disclosed in Japanese Examined Patent Publication Nos. 43-4,160 and 45-14,039 and Japanese Unexamined Patent Publication No. 48-27,736, and is widely employed in practice.

Namely, the thermosensitive recording material is advantageous in that colored images can be easily formed by heating alone, and the recording apparatus can be made compact and small in size, has a relatively low price, and can be easily maintained. Therefore, the thermosensitive recording material is appreciated as a useful information-recording material for recording outputs of printers used with, for example, computers, facsimile machines, automatic ticket-vending machines, scientific measurement recorders, and CRT medical measurement recorders.

Nevertheless, the conventional dye-forming type thermosensitive recording materials in which the thermosensitive colored image-forming layer comprises a conventional color-developing agent together with the dye precursor and the binder is disadvantageous in that the resultant colored images fade with the lapse of time, presumably because of a reversibility of the color-forming reaction of the dye precursor with the color-developing agent. This fading of the colored images is accelerated by exposure to light, high temperatures, and high humidity and is specifically promoted by contact with an oily or fatty substance or a plasticizer, to such an extent that the faded images cannot be recognized.

Many attempts have been made to retard or inhibit the fading of the colored images formed on a conventional thermosensitive colored image-forming layer containing a substantially colorless dye precursor comprising a lactone ring compound.

For example, Japanese Unexamined Patent Publication Nos 60-78,782, 59-167,292, 59-114,096 and 59-93,387 disclose a thermosensitive colored image-forming layer containing a phenolic antioxidant.

Japanese Unexamined Patent Publication No. 56-146,794 discloses a protective layer formed from a hydrophobic polymeric compound emulsion on a thermosensitive colored image-forming layer.

Japanese Unexamined Patent Publication No. 58-199,189 discloses formation of both an intermediate layer and a top layer on a thermosensitive colored image-forming layer; the former being formed from a water-soluble polymeric compound solution or a hydrophobic polymeric compound emulsion and the latter being formed from a solvent-soluble hydrophobic polymer on the intermediate layer.

Japanese Unexamined Patent Publication No. 62-164,579 discloses a thermosensitive colored image-forming layer containing an epoxy compound in addition to a phenolic color-developing agent.

Japanese Unexamined Patent Publication No. 62-169,681 discloses metal salts of specific salicylic acid derivatives usable as a color-developing agent.

In the thermosensitive colored image-forming layer containing the phenolic antioxidant, the resultant colored images exhibit a higher resistance to heat and moisture to a certain extent compared to the colored images formed on a conventional colored image-forming layer free from the phenolic antioxidant, but the improvement provided by the phenolic antioxidant is not satisfactorily high. Also, the phenolic antioxidant does not have the capability to enhance the resistance of the colored images to the oily or fatty substances, for example, salad oil, and plasticizer, for example, dioctyl phthalate. The resistance of the colored images to oily or fatty substance or a plasticizer is determined in such a manner that the colored images are brought into contact with an oily or fatty substance, for example, a salad oil or a plasticizer, and left in contact therewith for a predetermined time, and then a retention of the color density of the tested colored images is measured in comparison with an initial color density thereof.

When the protective layer or the intermediate and top layers are formed on the thermosensitive colored image-forming layer, the resultant colored images exhibit a significantly enhanced persistency when the salad oil or the dioctyl phthalate is brought into contact with the colored image-forming surface of the recording material for a short time. Nevertheless, when the contact of the salad oil or the dioctyl phthalate with the colored images for a long time, the complete fading of the colored images cannot be avoided. Therefore, the provision of the protecting layer or the intermediate and top layer cannot completely eliminate the undesirable color-fading of the images.

The addition of the epoxy compound to the phenolic color-developing agent, is not totally appreciated, because it takes a long time to stabilize the colored images formed on the colored image-forming layer after a heat-recording operation, and therefore, if salad oil, or a plasticizer is brought into contact with the colored image-forming layer immediately after the heat-recording operation, the resultant colored images fade to a great extent.

The addition of the metal salts of the specific salicylic acid derivative to the colored image-forming layer effectively enhances the resistances of the colored image-forming layer to the oily or fatty substances and to the plasticizers. When the resultant thermosensitive recording sheet is subjected to a colored image-recording procedure and then to a heat resistance test, however, an undesirable color-development occurs on non-image-formed white portions of the recorded sheet. Also, the utilization of the specific salicylic acid derivative metal salts is disadvantageous in that this chemical has a complicated chemical structure and thus is expensive.

Generally, a thermosensitive recording material having a high persistency of colored images, which must have a surface layer, contain a special additive or use a special color-forming material, is disadvantageous in that the thermosensitivity is relatively low.

Japanese Examined Patent Publication No. 60-21,075 and Japanese Unexamined Patent Publication No. 58-104,793 disclose the use of a certain type of aromatic amide compounds as a fusible sensitizing agent, in combination with conventional color-developing agents, typically 2,2-bis(4-hydroxyphenyl)propane (namely Bisphenol A), for the thermosensitive recording material. However, the combination of the fusible aromatic amide compound with the conventional Bisphenol A color-developing agent is disadvantageous in that the resultant thermosensitive colored image-forming layer has a low whiteness and is spontaneously stained during storage over a long period of time. Also, the resultant colored image-forming layer is unsatisfactory in that the resultant colored images thereon exhibit a poor persistency during storage and are easily faded within a short time when brought into contact with an oily substance or plasticizer.

SUMMARY OF THE INVENTION

An object of the present invention is to provide a thermosensitive recording material capable of forming colored images thereon having excellent resistance to oily and fatty substances and plasticizers, and thus exhibiting superior persistency over a long time.

Another object of the present invention is to provide a thermosensitive recording material useful for thermorecording type tickets of automatic ticket-vending machines, commuter passes, and coupon tickets, which must have high persistency of the colored images recorded thereon, and for label sheets to be used in a POS bar code price-indicating system in which the label sheets are frequently attached to a surface of a polyvinyl chloride film containing a plasticizer and for wrapping fresh food or meat containing an oily or fatty substance; the label sheets of which are unavoidably brought into contact with the plasticizer and/or oily or fatty substance.

A further object of the present invention is to provide a thermosensitive recording material useful as facsimile recording sheets, word processor recording sheets, and CRT image printing sheets, which all must have high persistency of colored images recorded thereon.

The above-mentioned objects can be attained by the thermosensitive recording material of the present invention, which comprises a sheet substrate and a thermosensitive colored image-forming layer formed on a surface of the sheet substrate and comprising a substantially colorless dye precursor, a color-developing agent reactive with the dye precursor upon heating to thereby develop a color, and a binder, the color-developing agent comprising at least one aromatic compound having, per molecule thereof, at least one arylsulfonylureido group of the formula (I):

$$R^1-SO_2NH\underset{\underset{O}{\|}}{C}NH- \quad (I)$$

wherein $R^1$ represents a member selected from the group consisting of unsubstituted aromatic groups and aromatic group substituted with at least one member selected from the group consisting of lower alkyl groups, lower alkoxyl groups and halogen atoms, and the thermosensitive colored image-forming layer further containing a sensitizing additive comprising at least one aromatic amide compound of the formula (II):

$$Ar^1-\underset{\underset{O}{\|}}{C}NH-Ar^2 \quad (II)$$

wherein $Ar^1$ and $Ar^2$ respectively and independently from each other represent a member selected from the group consisting of non-substituted phenyl and naphthyl groups and substituted phenyl and naphthyl groups each having 1 to 3 substituents selected from the group consisting of aryl groups, aryloxy groups, aralkyl groups, alkyl groups, alkoxyl groups, trihalogenomethyl groups, a nitro group, halogen atoms and alkylamino groups.

DESCRIPTION OF THE PREFERRED EMBODIMENTS

In the thermosensitive recording material of the present invention, the thermosensitive colored image-forming layer comprises a specific color-developing agent and a specific sensitizing additive in addition to a dye precursor and a binder.

The color-developing agent comprises at least one color-developing aromatic compound having, per molecule thereof, at least one arylsulfonylureido group of the formula (I):

$$R^1-SO_2NH\underset{\underset{O}{\|}}{C}NH- \quad (I)$$

wherein $R^1$ represents a member selected from the group consisting of unsubstituted aromatic groups and aromatic groups substituted with at least one member selected from the group consisting of lower alkyl group, preferably having 1 to 4 carbon atoms, lower alkoxyl groups preferably having 1 to 4 carbon atoms, and halogen atoms, for example, fluorine, chlorine and bromine atoms.

The aromatic groups represented by $R^1$ in the formula (I) are preferably selected from the group consisting of phenyl group, o, m and p-alkylphenyl groups, o, m and p-halogenophenyl group and o, m and p-alkoxyphenyl.

The specific aromatic compound having, per molecule thereof, at least one arylsulfonylureido group of the formula (I), does not have an acidic functional group, for example, a phenolic hydroxyl group or carboxyl group. Nevertheless, the aromatic compound exhibits a strong color-developing ability for the dye precursor consisting of a basic leuco dye. The reasons for the strong color-developing ability have not yet been made completely clear, but it is assumed that the urea group in the arylsulfonylureido group of the formula (I) is activated by the sulfonyl groups located adjacent to the urea group to enhance the color-developing activity of the aromatic compound.

The color-developing aromatic compound having, per molecule thereof, one arylsulfonylureido group of the formula (I) is preferably selected from the group consisting of:

N-(p-toluenesulfonyl)-N'-phenylurea (melting point: 165° C.),
N-(p-toluenesulfonyl)-N'-(p-methoxyphenyl)urea (m.p.: 155° C.),
N-(p-toluenesulfonyl)-N'-(o-tolyl )urea (m.p.: 148° C.),
N-(p-toluenesulfonyl)-N'-(m-tolyl)urea (m.p.: 184° C.),
N-(p-toluenesulfonyl)-N'-(p-tolyl)urea (m.p.: 149° C.),
N-(p-toluenesulfonyl)-N'-(p-n-butylphenyl)urea,
N-(p-toluenesulfonyl)-N'-(o-chlorophenyl)urea (m.p.: 180° C.),
N-(p-toluenesulfonyl)-N'-(m-chlorophenyl)urea (m.p.: 193° C.),
N-(p-toluenesulfonyl)-N'-(2,4-dichlorophenyl)urea,
N-(p-toluenesulfonyl)-N'-benzylurea (m.p.: 177° C.),
N-(p-toluenesulfonyl)-N'-(1-naphthyl)urea (m.p.: 124° C.),
N-(p-toluenesulfonyl)-N'-{1-(2-methylnaphthyl)-}urea,
N-(benzenesulfonyl)-N'-phenylurea (m.p.: 153° C.),
N-(p-chlorobenzenesulfonyl)-N'-phenylurea,
N-(o-toluenesulfonyl)-N'-phenylurea,
N-(p-toluenesulfonyl)-N'-methylurea (m.p.: 172° C.),
N-(p-toluenesulfonyl)-N'-ethylurea (m.p.: 141° C.),
N-(p-toluenesulfonyl)-N'-(2-phenoxyethyl)urea (m.p.: 191° C.),
N,N'-bis(p-toluenesulfonyl)urea (m.p.: 155° C.),
N-(p-toluenesulfonyl)-N'-(o-diphenyl)urea (m.p.: 148° C.),
N-(p-toluenesulfonyl)-N'-(p-ethoxycarbonylphenyl-)urea,
N-(p-toluenesulfonyl)-N'-butylurea (m.p.: 126° C.),
N-(p-chlorobenzenesulfonyl)-N'-propylurea (m.p.: 127° C.), and
N-(p-methoxybenzenesulfonyl)-N'-phenylurea (m.p.: 149° C.).

Also, the color-developing aromatic compound having, per molecule thereof, two or more arylsulfonylureido group of the formula (I) is preferably selected from the group consisting of:

bis{N'-(p-toluenesulfonyl)ureido}ketone,
1,2-bis{N'-(p-toluenesulfonyl)ureido}ethane,
1,1,6,6-tetra{N'-(p-toluenesulfonyl)ureido}heptane,
1,5-bis{N'-(p-toluenesulfonyl)ureido}-3-oxapentane,
1,5-bis{N'-(p-toluenesulfonyl)ureido}-3-thiopentane,
1,3-bis{N'-(p-toluenesulfonyl)ureido}-2-propanone,
1,5-bis{N'-(p-toluenesulfonyl)ureido}-3-[2'-{N'-(p-toluenesulfonyl)ureido}ethyl]-3-azapentane,
1,3-bis{N'-(p-toluenesulfonyl)ureido-N-methyl}benzene,
1,4-bis{N'-(p-toluenesulfonyl)ureido-N-methyl}benzene,
4,4'-bis{N'-(p-toluenesulfonyl)ureido}diphenylmethane,
4,4'-bis{N-(o-toluenesulfonyl)ureido}diphenylmethane,
4,4'-bis(benzenesulfonylureido)-diphenylmethane
4,4'-bis(1-naphthalenesulfonylureido)diphenylmethane,
2,2-bis[4',4''-{N'-(p-toluenesulfonyl)ureido}phenyl]-propane,
1,2-bis[4'-{N'-(p-toluenesulfonyl)ureido}phenyloxy]ethane,
2,5-bis[{N'-(p-toluenesulfonyl)ureido}methylfuran,
1,3-bis{N,-(p-toluenesulfonyl)ureido}benzene,
1,4-bis{N,-(p-toluenesulfonyl)ureido}benzene,
1,5-bis{N,-(p-toluenesulfonyl)ureido}naphthalene,
1,8-bis{N,-(p-toluenesulfonyl)ureido}naphthalene,
4,4,-bis{N,-(p-toluenesulfonyl)ureido}diphenylether,
3,3'-bis{N'-(p-toluenesulfonyl)ureido}diphenylsulfone,
4,4'-bis{N'-(p-toluenesulfonyl)ureido}diphenylsulfone,
2,4-bis{N,-(p-toluenesulfonyl)ureido}toluene,
2,6-bis{N,-(p-toluenesulfonyl)ureido}toluene,
4,4,-bis{N'-(p-toluenesulfonyl)ureido}diphenylsulfide, and
3,4,-bis{N,-(p-toluenesulfonyl)ureido}diphenylether.

The color-developing aromatic compounds having at least one arylsulfonylureido group are employed alone or as a mixture of two or more thereof.

The sensitizing additive in the colored image-forming layer comprises at least one aromatic compound of the formula (II):

$$Ar^1-\underset{\underset{O}{\|}}{C}NH-Ar^2 \qquad (II)$$

wherein $Ar^1$ and $Ar^2$ respectively and independently from each other represent a member selected from the group consisting of unsubstituted phenyl and naphthyl groups and substituted phenyl and naphthyl groups each having 1 to 3 substituents selected from the group consisting of aryl groups, for example, phenyl, naphthyl and phenanthryl groups; aryloxy groups, for example, phenoxy, naphthoxy and p-tolyloxy; aralkyl groups, for example, benzyl and naphthylmethyl groups; alkyl groups preferably having 1 to 8 carbon atoms; alkoxyl groups preferably having 1 to 4 carbon atoms; trihalogenomethyl groups, for example, trifluoromethyl group and trichloromethyl group; a nitro group; halogen atoms, for example, fluorine, chlorine and bromine atoms; and alkylaminogroup, for example, dimethylamino group and diethylamino group.

The sensitizing aromatic compounds of the formula (II) preferably have a melting temperature of 60° C. to 180° C. When the melting temperature is lower than 60° C., sometimes an undesirable color forming reaction occurs during the production of the thermosensitive recording material, or the resultant thermosensitive recording material sometimes exhibits a reduced whiteness.

Also, when the melting temperature is higher than 180° C., the resultant aromatic compound sometimes exhibits an unsatisfactory sensitizing activity and thus the resultant thermosensitive recording material sometimes exhibits an unsatisfactory sensitivity.

The sensitizing aromatic amide compound of the formula (II) is preferably selected from the group consisting of:

benzanilide (melting point: 164° C.),
2-methyl-benzanilide (m.p.: 127° C.),
benz-m-toluidide (m.p.: 125° C.), benz-p-toluidide (m.p.: 151° C.),
benz-o-toluidide (m.p.: 143° C.),
benz-o-anisidide (m.p.: 66° C.),
benz-p-anisidide (m.p.: 158° C.),
4-methyl-benz-o-anisidide (m.p.: 75° C.),
benz-p-phenetidide,
benz-o-phenetidide (m.p.: 56° C.),
benz-2'-chloroanilide (m.p.: 105° C.),
benz-3'-chloroanilide (m.p.: 118° C.),
benz-4'-chloroanilide (m.p.: 195° C.),
4-methyl-benz-3'-chloroanilide (m.p.: 119° C.),
3-methyl-benz-4'-chloroanilide (m.p.: 96° C.),
3-methyl-benz-3'-chloroanilide (m.p.: 94° C.),
4-methyl-benz-3'-trifluoromethylanilide (m.p.: 101° C.),
3-methyl-benz-3'-trifluoromethylanilide (m.p.: 100° C.),
benz-3'-trifluoromethylanilide (m.p.: 111° C.),
3-bromobenz-o-anisidide (m.p.: 113° C.),
4-nitrobenz-o-anisidide (m.p.: 146° C.),
3-nitrobenz-m-anisidide (m.p.: 123° C.),
benz-3'-methyl-o-anisidide (m.p.: 101° C.),
benz-4'-chloro-5'-methyl-o-anisidide (m.p.: 85° C.),
benz-5'-methyl-4'-nitro-o-anisidide (m.p.: 123° C.),
benz-2',4'-dimethoxyanilide (m.p.: 173° C.),
benz-4'-chloro-p-phenetidide (m.p.: 171° C.),
benz-5'-methyl-4'-nitro-o-phenetidide (m.p.: 158° C.),
benz-4'-chloro-2',5'-diethoxyanilide (m.p.: 132° C.),
benz-2'-chloro-p-toluidide (m.p.: 139° C.),
4-chlorobenz-p-toluidide (m.p.: 73° C.),
2-methylbenz-o-toluidide (m.p.: 140° C.),
2,4,6,-trimethylbenz-p-toluidide (m.p.: 173° C.),
2,4,6,-trimethylbenz-o-toluidide (m.p.: 124° C.),
benz-4'-chloro-o-toluidide (m.p.: 171° C.),
2-methylbenz-4'-chloro-o-toluidide (m.p.: 182° C.),
2-chlorobenz-2'-chloroanilide (m.p.: 100° C.),
α-naphtho-2'-chloroanilide (m.p.: 105° C.),
2-chlorobenz-3'-chloroanilide (m.p.: 129° C.) ,
2-chlorobenz-4'-chloroanilide (m.p.: 121° C.) ,
2-methylbenz-4'-chloroanilide (m.p.: 133° C.),
3,4-dimethylbenzanilide (m.p.: 108° C.) ,
benz-2',3'-dimethylanilide (m.p.: 138° C.),
benz-2',5'-dimethylanilide (m.p.: 147° C.),
benz-3',4'-dimethylanilide (m.p.: 185° C.),
benz-2'-chloro-5'-phenoxyanilide (m.p.: 86° C.),
3-dimethylaminobenzanilide,
2-phenylbenzanilide,
2-benzylbenzanilide, and
N-(1-naphthyl)benzamide.

The sensitizing aromatic compounds are employed alone or as a mixture of two or more thereof.

The sensitizing aromatic compounds of the formula (II) can be readily prepared by a reaction of a corresponding arylcarbonyl chloride with a corresponding arylamine.

The dye precursor usable for the present invention comprises at least one member selected from conventional triphenylmethane, fluoran, and diphenylmethane leuco dyes, for example, 3-(4-diethylamino-2-ethoxyphenyl)-3-(1-ethyl-2-methylindole-3-yl)-4-azaphthalide, crystal violet lactone, 3-(N-ethyl-N-isopentylamino)-6-methyl-7-anilinofluoran, 3-diethylamino-6-methyl-7-anilinofluoran, 3-diethylamino-6-methyl-7-(o,p-dimethylphenylamino)fluoran, 3-(N-ethyl-N-p-toluidino)-6-methyl-7-anilinofluoran, 3-pyrrolidino-6-methyl-7-anilinofluoran, 3-dibutylamino-6-methyl-7-anilinofluoran, 3-(N-cyclohexyl-N-methylamino)-6-methyl-7-anilinofluoran, 3-diethylamino-7-(o-chloroanilino)fluoran, 3-dibutylamino-7-(m-trifluoromethylanilino)fluoran, 3-diethylamino-6-methyl-7-chlorofluoran, 3-diethylamino-6-methylfluoran, 3-cyclohexylamino-6-chlorofluoran, 3-(N-ethyl-N-hexylamino)-6-methyl-7-(p-chloroanilino)fluoran, 3-diethylamino-7-(m-trifluoromethylanilino)fluoran, 3-dibutylamino-7-(o-chloroanilino)fluoran, and 3-dipentylamino-6-methyl-7-anilinofluoran.

In the thermosensitive colored image-forming layer, the binder serves to bond the components in the colored image-forming layer to the substrate sheet and preferably comprises at least one member selected from water-soluble polymeric materials, for example, polyvinyl alcohols of various molecular weight, starch and starch derivatives, cellulose derivatives, for example, methoxy cellulose, carboxymethyl cellulose, methyl cellulose and ethyl cellulose, sodium polyacrylate, polyvinyl pyrrolidine, acrylic acid amide-acrylic acid ester copolymers, acrylic acid amide-acrylic acid ester-methacrylic acid terpolymers, alkali salts of styrene-maleic anhydride copolymers, polyacrylic acid amide, sodium alginate, gelatine and casein, and water-insoluble polymeric materials, for example, polyvinyl acetate resins, polyurethane resins, styrene-butadiene copolymer resins, polyacrylic acid resins, polyacrylic acid ester resins, vinyl chloride-vinyl acetate copolymer resins, polybutyl acrylate, ethylene-vinyl acetate copolymer resins and styrene-butadiene-acrylic compound-terpolymer resins, used in the form of a latex.

In the thermosensitive colored image-forming layer of the present invention, the dye precursor is preferably present in an amount of 5 to 20% by weight, and the color-developing aromatic compound having, per molecule thereof, at least one arylsulfonylureido group, is present preferably in an amount of 5 to 50% by weight, based on the total weight of the thermosensitive colored image-forming layer.

If the content of the color-developing aromatic compound is less than 5% by weight, the resultant thermosensitive colored image-forming layer sometimes exhibits an unsatisfactory color-developing ability. Also, even if the content of the color-developing aromatic compound is more than 50% by weight, the color-developing ability of the resultant colored image-forming layer is saturated and thus sometimes an economical disadvantage occurs.

The sensitizing aromatic compound of the formula (II) is present preferably in an amount of 5 to 50% by weight based on the total weight of the colored image-forming layer. If the content of the sensitizing aromatic compound of the formula (I) is less than 5% by weight, the sensitizing effect on the colored image-forming layer is unsatisfactory and even if the content is more than 50% by weight, the sensitizing effect is saturated and thus no further enhancement of the sensitizing effect is expected.

The binder is present preferably in an amount of 5 to 20% by weight based on the total dry weight of the colored image-forming layer.

The thermosensitive colored image-forming layer optionally further comprises an additive consisting of at least one member selected from aromatic compounds having at least one epoxy group, aromatic compounds having at least one aziridinyl group, conventional color-developing , agents (phenolic compounds or organic carboxylic acid compounds), conventional sensitizing agents, antioxidants, for example, hindered phenol compounds, ultraviolet ray absorbers, and waxes. Still further, the colored image-forming layer optionally comprises a pigment consisting of at least one member selected from inorganic pigments and organic pigments.

Where the colored image-forming layer comprises the above-mentioned additive, preferably the aromatic epoxy and/or aziridinyl compound is present in an amount of 1 to 30% by weight, the antioxidant and/or the ultraviolet ray absorber is present in an amount of 1 to 10% by weight, the conventional phenol or organic acid type color-developing agent is present in an amount of 5 to 40% by weight, the conventional sensitizing agent is present in an amount of 10 to 40% by weight, the wax is present in an amount of 2 to 20% by weight and the pigment is present in an amount of 2 to 50% by weight, each based on the total dry weight of the colored image-forming layer.

In the thermosensitive recording material of the present invention, the thermosensitive colored image-forming layer optionally comprises an additive consisting of at least one member selected from the group consisting of aromatic compounds having at least one epoxy ring group and an aromatic compound having at least one aziridinyl group. The examples of the those compounds are disclosed in Japanese Unexamined Patent Publication (JP-A) Nos. 62-164,579, 2-220,885 and 2-255,376. The epoxy and aziridinyl compounds contribute to enhancing the resistance of the colored images to oily substances, plasticizers, heat and moisture, and are preferably selected from, for example, 4,4'-bis(2'',3''-epoxypropyloxy)diphenylsulfone,
2,2-bis{4'-(2'',3''-epoxypropyloxy)phenyl}propane,
1,4-bis(2',3'-epoxypropyloxy)benzene,
4-(2'-methyl-2',3'-epoxypropyloxy)-4'-benzyloxydiphenylsulfone,
4-(2'',3''-epoxypropyloxy)-4'-(p-methylbenzyloxy)-diphenylsulfone,
epoxidized orthonovolak cresol resins,
4,4'-bis(2'',3''-epoxypropyloxy)diphenylmethane,
4,4'-bis(2'',3''-epoxypropylamino)diphenylmethane,
bis(2'',3''-epoxypropyl)-4,4'-methylene dibenzoate,
4,4'-bis(2'',3''-epoxypropyloxy)biphenyl,
4,4'-bis(2'',3''-epoxypropyloxy)-3,3,5,5'-tetramethylbiphenyl,
2,6-bis(2',3'-epoxypropyloxy)naphthalene,
bis(2,3-epoxypropyl)terephthalate,
2,4-bis(1-aziridinylcarbonylamino)toluene,
bis{4-(1-aziridinylcarbonylamino)phenyl}methane,
bis{3-chloro-4-(1aziridinylcarbonylamino)-phenyl}methane,
2,2-bis{4-(1-aziridinylcarbonyloxy)phenyl}propane,
1,4-bis(1-aziridinylcarbonyloxy)benzene, and
1,4-bis(1-aziridinylcarbonyl)benzene.

The conventional color-developing agent comprising at least one member selected from color-developing phenol compounds and organic acid compounds, can be used together with the specific aromatic compound having at least one arylsulfonylureido group of the formula (I), unless it hinders the desired effect of the present invention.

The conventional color forming agent usable for the present invention comprises for example, at least one member selected from 2,2-bis(4-hydroxyphenyl)propane (namely bisphenol A), 1,1-bis(4-hydroxyphenyl)-1-phenylethane, 1,4-bis[1-methyl-1-(4'-hydroxyphenyl)ethyl]benzene, 1,3-bis[1-methyl-1-(4'-hydroxyphenyl)ethyl]benzene, dihydroxydiphenylether (disclosed in JP-A-1-180,382), benzyl p-hydroxy-benzoate (disclosed in JP-A-52-140,483), bisphenol S, 4-hydroxy-4'-isopropyl-oxydiphenylsulfone (disclosed in JP-A-60-13,852), 1,1-di(4-hydroxyphenyl)-cyclohexane, 1,7-di(4-hydroxyphenylthio)-3,5-dioxaheptane (disclosed in JP-A-59-52,694), and 3,3'-diallyl-4,4'-dihydroxydiphenylsulfone (disclosed in JP-A-60-208,286).

The above-mentioned conventional color-developing compounds can be employed alone or as a mixture of two or more thereof.

The conventional sensitizing agent usable, together with the aromatic compound of the formula (II), for the present invention comprises at least one heat-fusible organic compound having a melting point of 50° C. to 180° C., for example, phenyl 1-hydroxy-2-naphthoate (JP-A-57-191,089), p-benzyl-biphenyl (JP-A-60-82,382), benzyl-naphthylether (JP-A-58-87,094), dibenzyl terephthalate (JP-A-58-98,285), benzyl p-benzyloxybenzoate (JP-A-57-201,691), diphenyl carbonate, ditolyl carbonate (JP-A-58-136,489), m-terphenyl (JP-A-57-89,994), 1,2-bis(m-tolyloxy)ethane (JP-A-60-56,588), 1,5-bis(p-methoxyphenoxy)-3-oxapentane (JP-A-62-181,183), oxalic acid diesters (JP-A-64-1,583) and 1,4-bis(p-tolyloxy)benzene (JP-A-2-153,783).

The antioxidants and ultraviolet ray-absorbers usable for the present invention are preferably selected from those disclosed in JP-A-57-151,394, JP-A-58-160,191, JP-A-58-69,096, JP-A-59-2,884, JP-A-59-95,190, JP-A-60-22,288, JP-A-60-255,485, JP-A-61-44,686, JP-A-62-169,683, JP-A-63-17,081 and JP-A-1-249,385, for example, 1,1,3-tris(3'-cyclohexyl-4'-hydroxyphenyl)butane; 1,1,3-tris(2-methyl-4-hydroxy-5-cyclohexylphenyl)butane, 1,1,3-tris(2-methyl-4-hydroxy-5-tert-butylphenyl)-butane, 4,4-thio-bis(3-methyl-6-tert-butylphenol), 1,3,5-trimethyl-2,4,6-tris(3,5-di-tert-butyl-4-hydroxybenzyl)-benzene, 2,2'-dihydroxy-4, 4'-dimethoxybenzophenone, p-octylphenyl salycilate, 2-(2'-hydroxy-5'-methylphenyl)benzotriazole, ethyl-2-cyano-3,3'-diphenyl acrylate, and tetra(2,2,6,6-tetramethyl-4-piperidyl)-1,2,3,4-butane-tetracarbonate.

The inorganic and organic pigments usable for the present invention are preferably selected from inorganic fine particles of, for example, calcium carbonate, silica, zinc oxide, titanium dioxide, aluminum hydroxide, zinc hydroxide, barium sulfate, clay, anhydrous clay, talc, and surface-treated calcium carbonate and silica and organic fine particles of, for example, urea-formaldehye resins, styrene-methacrylate copolymer resins and polystyrene resins.

The waxes usable for the present invention preferably comprises at least one member selected from, for example, paraffin waxes, carnauba wax, microcrystalline waxes, polyethylene waxes, amide type waxes, bisimide type waxes, higher fatty acid amide waxes, for example, stearic acid amide, ethylene-bis-stearoamide wax, higher fatty acid esters and metal salts, for example, zinc stearate, aluminum stearate calcium stearate and zinc oleate.

The sheet substrate usable for the present invention is not limited to a specific group of materials, and usually the sheet substrate comprises a member selected from fine paper sheets, coated paper sheet having a clay or latex-coated layer, cast-coated paper sheets, paper boards, plastic resin films, synthetic paper sheets comprising a plastic resin such as a polyolefin resin and a multi-layer structure, and laminated composite sheets. Preferably, the sheet substrate has a basis weight of 40 to 170 g/m$^2$.

The colored image-forming layer can be formed on a surface of a sheet substrate, by applying a coating liquid containing the above-mentioned components, and by drying and solidifying the coating liquid layer on the sheet substrate.

The colored image-forming layer is preferably present in a dry weight of from 1 to 15 g/m$^2$, more preferably 2 to 10 g/m$^2$.

In the thermosensitive recording material of the present invention, a protective layer and/or an additional layer for printing may be formed on the colored image-forming layer.

In the thermosensitive recording material of the present invention, the color-developing aromatic compounds having at least one arylsulfonylureido group of the formula (I) exhibit a color-developing activity comparative to or higher than that of bisphenol A which is a typical conventional color-developing compound.

Also, when the color-developing aromatic compound is present together with the sensitizing aromatic compound of the formula (II), the resultant colored image-forming layer exhibits a satisfactory thermosensitivity and can record clear colored images thereon without staining the non-image-formed portions thereof and the resultant colored images exhibit an excellent resistance to oily and fatty substances and a plasticizer and thus have a superior storage persistency.

EXAMPLES

The present invention will be further explained by the following specific examples, which are merely representative and do not in any way restrict the scope of the present invention.

Synthesis Example 1

Preparation of 4-methylbenz-o-anisidide

A three necked flack having a capacity of 100 ml and equipped with a dropping funnel, a thermometer and a drying tube packed with calcium chloride, was charged with 13.6 g of o-anisidine and 30 ml of pyridine. While stirring the solution in the flack by using a magnetic stirrer, 17.0 g of p-toluoyl chloride was added dropwise from the dropping funnel to the solution in such a manner that the temperature of the resultant reaction mixture did not exceed a level of 40° C. Simultaneously with the start of the dropwise addition, an exothermic reaction occurred, and a solid substance was gradually precipitated. Finally, the entire reaction system was solidified so that the stirring became impossible. The reaction was completed after 2 hours from the start thereof. To the reaction system, an acid water containing hydrochloric acid was added, and then the solid product was pulverized and filtered to collect the reaction product. The reaction product was recrystallized by using a mixed solvent consisting of ethyl alcohol and water. White crystals were obtained in an amount of 25.7 g, and had a melting temperature of 75° C. to 76° C. An NMR measurement, a mass spectrometric analysis and an IR measurement identified that the resultant crystals consisted of the aimed compound.

Synthesis Example 2

Preparation of 2-methylbenzanilide

A three necked flack having a capacity of 100 ml, and equipped with a dropping funnel, a thermometer and a drying tube packed with calcium chloride, was charged with 11.2 g of aniline and 30 ml of pyridine. While stirring the solution in the flack by using a magnetic stirrer, 18.5 g of o-toluoyl chloride was added dropwise from the dropping funnel to the solution in such a manner that the temperature of the resultant reaction mixture did not exceed a level of 40° C. Simultaneously with the start of the dropwise addition, an exothermic reaction occurred, and a solid substance was gradually precipitated. Finally, the entire reaction system was solidified so that the stirring became impossible. The reaction was completed after 2 hours from the start thereof. To the reaction system, an acid water containing hydrochloric acid was added, and then the solid product was pulverized and filtered to collect the reaction product. The reaction product was recrystallized by using a mixed solvent consisting of ethyl alcohol and water. White crystals were obtained in an amount of 24.1 g, and had a melting temperature of 127° C. to 129° C. An NMR measurement, a mass spectrometric analysis and an IR measurement identified that the resultant crystals consisted of the aimed compound.

Synthesis Example 3

Preparation of 4-methylbenz-3'-chloroanilide

A three necked flack having a capacity of 100 ml, and equipped with a dropping funnel, a thermometer and a drying tube packed with calcium chloride, was charged with 14.0 g of m-chloroaniline and 30 ml of pyridine. While stirring the solution in the flack by a magnetic stirrer, 17.0 g of p-toluoyl chloride was added dropwise from the dropping funnel to the solution in such a manner that the temperature of the resultant reaction mixture did not exceed a level of 40° C. Simultaneously with the start of the dropwise addition, an exothermic reaction occurred, and a solid substance was gradually precipitated. Finally, the entire reaction system was in the state of a slurry. The reaction was completed after 2 hours from the start thereof. To the reaction system, an acid water containing hydrochloric acid was added to solidify the reaction mixture, and then the solid product was pulverized and filtered to collect the reaction product. The reaction product was recrystallized by using a mixed solvent consisting of ethyl alcohol and water. White crystals were obtained in an amount of 26.1 g, and had a melting temperature of 118° C. to 120° C. An NMR measurement, a mass spectrometric analysis and an IR measurement identified that the resultant crystals consisted of the aimed compound.

EXAMPLE 1

A thermosensitive recording paper sheet was prepared by the following procedures.

(1) Preparation of a pigment-coated paper sheet

A coating liquid was prepared by mixing an aqueous dispersion prepared by dispersing 85 parts by weight of anhydrous clay available under the trademark of Ansilex, from Engelhard Corporation, in 320 parts by weight of water, with 40 parts by weight of an aqueous emulsion of a styrene-butadiene copolymer in a solid concentration of 50% by weight and 50 parts by weight of a 10% aqueous oxidized starch solution.

The coating liquid was coated on a surface of a fine paper sheet having a basis weight of 48 g/m$^2$, to form a coating layer having a dry weight of 7.0 g/m$^2$, whereby a coated paper sheet was obtained.

(2) Preparation of an aqueous dye precursor Dispersion A

A mixture was prepared in the following composition.

| Component | Part by weight |
|---|---|
| 3-(N-isopentyl-N-ethylamino)-6-methyl-7-anilinofluoran | 20 |
| 10% aqueous solution of polyvinyl alcohol | 10 |
| Water | 70 |

The mixture was dispersed by using a sand grinder to an extent such that the resultant dispersed solid particles had an average size of 1 μm or less.

(3) Preparation of an aqueous color-developing agent dispersion B

| Component | Part by weight |
|---|---|
| N-(p-toluenesulfonyl)-N'-phenylurea | 20 |
| 10% aqueous solution of polyvinyl alcohol | 10 |
| Water | 70 |

The mixture was dispersed by using a sand grinder to such an extent that the resultant dispersed solid particles had an average size of 1 μm or less.

(4) Preparation of an aqueous sensitizing agent dispersion C

| Component | Part by weight |
|---|---|
| 4-methylbenz-o-anisidide | 20 |
| 10% aqueous solution of polyvinyl alcohol | 10 |
| Water | 70 |

The mixture was dispersed by using a sand grinder to an extent that the resultant dispersed solid particles had an average size of 1 μm or less.

(5) Formation of thermosensitive colored image-forming layer

A coating liquid was prepared by evenly mixing 60 parts by weight of the aqueous dye precursor dispersion A, 120 parts by weight of the aqueous color-developing agent dispersion B and 120 parts by weight of 30% the aqueous sensitizing agent with 26 parts by weight of a calcium carbonate pigment, 12 parts by weight of a 25% aqueous zinc stearate dispersion, 10 parts by weight of a aqueous paraffin dispersion, and 80 parts by weight of a 10% aqueous polyvinyl alcohol solution, by agitating the mixture.

A surface of the pigment coated paper sheet was coated with the resultant coating liquid and dried. A thermosensitive colored image-forming layer was formed in a weight of 5.0 g/m$^2$, to provide a thermosensitive recording paper sheet.

(6) The recording paper sheet was treated by a super calendar, and the calendared surface of the recording paper sheet had a Bekk smoothness of 800 to 1000 seconds.

(7) Color-developing test

The specimen of the resultant thermosensitive recording sheet was subjected to a colored image-developing test by using a thermosensitive recording sheet-printing tester (trademark THPMD, made by Okura Denki K.K.) equipped with a thermal head made by Kyocera. The specimen was color-formed under a voltage of 22 V, at a line width of 4 m sec. and at a pulse width of 0.7 m sec. The resultant colored specimen were subjected to a measurement of a color density by a Macbeth Reflection Color Density Tester RD-914 (trademark).

The measured color density of the colored images on the specimen is referred to as an original color density ($D_0$) of the colored images.

Also, the specimen was heated by using a heat inclination tester made by Toyo Seiki, at a temperature of 70° C. under a pressure of 2.5 kg/cm$^2$ for 5 seconds, and the color density of the heated colored image-forming layer was determined by the above-mentioned color density tester. The measured value of the color density is referred to as a static color-forming performance which represents a resistance of the colored imaged-forming layer to the thermal color-formation at a relatively high temperature.

The test results are shown in Table 1.

EXAMPLE 2

A thermosensitive recording sheet was prepared by the same procedures as in Example 1, except that in the preparation of the dispersion C, the 4-methylbenzanisidide was replaced by 4-methyl-benzanilide.

The test results are shown in Table 1.

EXAMPLE 3

A thermosensitive recording sheet was prepared by the same procedures as in Example 1, except that in the preparation of the dispersion C, the 4-methylbenzanisidide was replaced by 4-methylbenz-3'-chloroanilide.

The test results are shown in Table 1.

EXAMPLE 4

A thermosensitive recording sheet was prepared by the same procedures as in Example 1, except that in the preparation of the dispersion C, the 4-methylbenzanisidide was replaced by 2,4,6-trimethylbenz-o-toluidide.

The test results are shown in Table 1.

EXAMPLE 5

A thermosensitive recording sheet was prepared by the same procedures as in Example 1, except that in the preparation of the dispersion A, the 3-(N-ethyl-N-isopentylamino)-6-methyl-7-anilinofluoran was replaced by 3-dibutylamino-6-methyl-7-anilinofluoran, and in the preparation of the dispersion B, the N-(p-toluenesulfonyl)-N'-phenylurea was replaced by N-(p-toluenesulfonyl)-N'-(p-methoxyphenyl)urea.

The test results are shown in Table 1.

COMPARATIVE EXAMPLE 1

A thermosensitive recording sheet was prepared by the same procedures as in Example 1, except that in the formation of the colored image-forming layer, the dispersion C was not employed.

The test results are shown in Table 1.

COMPARATIVE EXAMPLE 2

A thermosensitive recording sheet was prepared by the same procedures as in Example 1, except that in the preparation of the dispersion C, the 4-methylbenzanisidide was replaced by p-benzyl-biphenyl.

The test results are shown in Table 1.

COMPARATIVE EXAMPLE 3

A thermosensitive recording sheet was prepared by the same procedures as in Example 1, except that in the preparation of the dispersion B, the N-(p-toluene-sulfonyl)-N'-phenylurea was replaced by 2,2-bis(4hydroxyphenyl)propane, namely bisphenol A.

The test results are shown in Table 1.

TABLE 1

| Example No. | Item | Color density (D) of colored images (0.7 m sec.) | Static color-forming performance (color density) |
|---|---|---|---|
| Example | 1 | 1.32 | 0.08 |
| | 2 | 1.29 | 0.09 |
| | 3 | 1.29 | 0.08 |
| | 4 | 1.30 | 0.08 |
| | 5 | 1.26 | 0.07 |
| Comparative Example | 1 | 0.72 | 0.07 |
| | 2 | 1.02 | 0.08 |
| | 3 | 1.33 | 0.14 |

As Table 1 clearly shows, where the aromatic compound having the arylsulfonylureido group of the formula (I) was employed as a color-developing agent, the sensitizing aromatic compound of the formula (II) exhibits a high sensitizing effect and the resultant colored image-forming layer exhibited a color-forming performance comparable to that obtained by using bisphenol A which is a typical conventional color-developing agent, and no stain was formed on the non-image formed portion of the colored image-forming layer. Also, it was confirmed that the sensitizing aromatic compound of the formula (II) employed in combination with the color-developing aromatic compound having the arylsulfonylureido group of the formula (II) exhibited a higher sensitizing effect than that of p-benzylbiphenyl which exhibits an excellent sensitizing effect when employed in combination with bisphenol A.

EXAMPLE 6

A thermosensitive recording sheet was prepared by the same procedures as in Example 1 with the following exceptions.

In the preparation of the dispersion B, the N-(p-toluenesulfonyl)-N'-phenylurea was replaced by 4,4'-bis{N'-(p-toluenesulfonyl)ureido}diphenylmethane.

A specimen of the resultant recording sheet was color-formed by using the thermosensitive recording sheet-printing tester (trademark: THPMD, made by Okura Denki K.K.) equipped with a thermal head made by Kyocera, under a voltage of 22 V at a line width of 4 m seconds at a pulse width of 0.7 m second or 1.0 m second. The color density of the specimen was measured by a Macbeth Reflection Color Density Tester RD-914.

The measured color density of the colored specimen generated at the pulse width of 0.7 m sec. is referred to as an recording sensitivity of the specimen.

Also, to the specimen color-formed at the pulse width of 1.0 m sec., a salad oil or dioctyl phthalate (DOP which is a typical plasticizer) was applied within 30 minutes from the color formation. The applied specimen was left to stand at room temperature for 30 minutes, the salad oil or the plasticizer was wiped away from the specimen surface, and the color density of the remaining colored images was measured by the MacBeth Reflection Color Density Tester.

The retention of the colored images was calculated in accordance with the following equation.

$$CIR(\%) = \frac{D}{D_0} \times 100$$

wherein CIR represents the retention in % in color density of the colored images, Do represents the initial color density of the colored images and D represents the color density of the salad oil or plasticizer-treated colored images.

The test results are shown in Table 2.

EXAMPLE 7

A thermosensitive recording sheet was prepared by the same procedures as in Example 6, except that in the preparation of the dispersion C, the 4-methylbenzanisidide was replaced by 4-methylbenz-anilide.

The test results are shown in Table 2.

EXAMPLE 8

A thermosensitive recording sheet was prepared by the same procedures as in Example 6, except that in the preparation of the dispersion C, the 4-methylbenzanisidide was replaced by 4-methylbenz-3'-chloroanilide.

The test results are shown in Table 2.

EXAMPLE 9

A thermosensitive recording sheet was prepared by the same procedures as in Example 6, except that in the preparation of the dispersion C, the 4-methylbenzanisidide was replaced by 2,4,6-trimethylbenz-o-toluidide.

The test results are shown in Table 2.

EXAMPLE 10

A thermosensitive recording sheet was prepared by the same procedures as in Example 6, except that in the preparation of the dispersion C, the 4-methylbenzanisidide was replaced by benz-4'-chloro-5'-methyl-o-anisidide.

The test results are shown in Table 2.

EXAMPLE 11

A thermosensitive recording sheet was prepared by the same procedures as in Example 6, except that in the preparation of the dispersion C, the 4-methylbenzanisidide was replaced by 4-methylbenz-3'-trifluoromethylanilide.

The test results are shown in Table 2.

EXAMPLE 12

A thermosensitive recording sheet was prepared by the same procedures as in Example 6, except that in the preparation of the dispersion A, the 3-(N-isopentyl-N-ethylamino)-6-methyl-7-anilinofluoran was replaced by 3-dibutylamino-6-methyl-7-anilinofluoran, and in the preparation of the dispersion B, the 4,4'-bis{N'-(p-toluenesulfonyl)ureido}diphenylmethane was replaced by 4,4'-bis{N'-(p-toluenesulfonyl)ureido}diphenylether.

The test results are shown in Table 2.

EXAMPLE 13

A thermosensitive recording sheet was prepared by the same procedures as in Example 6, except that in the formation of the colored image-forming layer, the dispersion B was replaced by a dispersion D having the composition as indicated below.

| Component | Part by weight |
|---|---|
| 4,4'-bis{N'-(p-toluenesulfonyl) ureido}diphenylmethane | 12 |
| N-(p-toluenesulfonyl)-N'-phenyl urea | 8 |

-continued

| Component | Part by weight |
|---|---|
| 10% aqueous polyvinyl alcohol solution | 10 |
| Water | 70 |

The mixture was dispersed in a sand grinder to an extent that the dispersed solid particles had an average size of 1 μm or less.

The test results are shown in Table 2.

EXAMPLE 14

A thermosensitive recording sheet was prepared by the same procedures as in Example 6, except that in the formation of the colored image-forming layer, the dispersion B was replaced by a dispersion E having the composition as indicated below.

| Component | Part by weight |
|---|---|
| 4,4'-bis{N'-(p-toluenesulfonyl) ureido}diphenylmethane | 12 |
| N-(p-toluenesulfonyl)-N'-butylurea | 8 |
| 10% aqueous polyvinyl alcohol solution | 10 |
| Water | 70 |

The mixture was dispersed in a sand grinder to such an extent that the resultant dispersed solid particles had an average size of 1 μm or less.

The test results are shown in Table 2.

COMPARATIVE EXAMPLE 4

A thermosensitive recording sheet was prepared by the same procedures as in Example 6, except that in the formation of the colored image-forming layer, the dispersion C was not employed.

The test results are shown in Table 2.

COMPARATIVE EXAMPLE 5

A thermosensitive recording sheet was prepared by the same procedures as in Example 6, except that in the preparation of the dispersion B, the 4,4'-bis{N'-(p-toluenesulfonyl)ureido}diphenylmethane was replaced by 2,2-bis(4-hydroxyphenyl)propane, namely bisphenol A.

The test results are shown in Table 2.

TABLE 2

| | | Color density of recorded colored image | | Colored image retention (%) | |
|---|---|---|---|---|---|
| Example No. | Item | 0.7 m sec. | 1.0 m sec. | Salad oil | DOP |
| Example | 6 | 1.06 | 1.31 | 101 | 87 |
| | 7 | 1.11 | 1.39 | 99 | 88 |
| | 8 | 1.14 | 1.38 | 100 | 87 |
| | 9 | 1.15 | 1.36 | 101 | 89 |
| | 10 | 1.13 | 1.40 | 99 | 84 |
| | 11 | 1.16 | 1.39 | 97 | 85 |
| | 12 | 1.04 | 1.30 | 100 | 84 |
| | 13 | 1.26 | 1.44 | 93 | 51 |
| | 14 | 1.29 | 1.45 | 92 | 52 |
| Comparative | 4 | 0.24 | 1.10 | 112 | 88 |
| Example | 5 | 1.33 | 1.37 | 22 | 19 |

Table 2 clearly shows that when the sensitizing aromatic compound of the present invention is employed in combination of bisphenol A which is a typical conventional color-developing agent, the resultant colored images exhibited very poor resistance to the salad oil and to the plasticizer, as shown in Comparative Example 5. Also, Examples 6 to 14 clearly show that the combination of the color-developing aromatic compound having at least one aryl-sulfonylureido group of the formula (I) with the sensitizing aromatic compound of the formula (II) contributes to causing the resultant colored images to exhibit high resistance to the oily and fatty substances and to the plasticizers, even immediately after the color formation.

We claim:

1. A thermosensitive recording material comprising:

a substrate sheet; and a thermosensitive colored image-forming layer formed on a surface of the substrate sheet and comprising a substantially colorless dye precursor, a color-developing agent reactive with the dye precursor upon heating to thereby develop a color, and a binder, the color-developing agent comprising at least one aromatic compound having, per molecule thereof, at least one arylsulfonylureido group of the formula (I):

$$R^1-SO_2NH\underset{\underset{O}{\|}}{C}NH- \quad (I)$$

wherein $R^1$ represents a member selected from the group consisting of unsubstituted aromatic groups and aromatic groups substituted with at least one member selected from the group consisting of lower alkyl groups, lower alkoxyl groups and halogen atoms, and the thermosensitive colored image-forming layer further containing a sensitizing additive comprising at least one aromatic amide compound of the formula (II):

$$Ar^1-\underset{\underset{O}{\|}}{C}NH-Ar^2 \quad (II)$$

wherein $Ar^1$ and $Ar^2$ respectively and independently from each other represent a member selected from the group consisting of unsubstituted phenyl and naphthyl groups and substituted phenyl and naphthyl groups each having 1 to 3 substituents selected from the group consisting of aryl groups, aryloxy groups, aralkyl groups, alkyl groups, alkoxyl groups, trihalogenomethyl groups, a nitro group, halogen atoms and alkylamino groups.

2. The thermosensitive recording material as claimed in claim 1, wherein the color-developing aromatic compound having, per molecule thereof, one arylsulfonylureido group of the formula (I) is selected from the group consisting of:

N-(p-toluenesulfonyl)-N'-phenylurea,
N-(p-toluenesulfonyl)-N'-(p-methoxyphenyl)urea,
N-(p-toluenesulfonyl)-N'-(o-tolyl)urea,
N-(p-toluenesulfonyl)-N'-(m-tolyl)urea,
N-(p-toluenesulfonyl)-N'-(p-tolyl)urea,
N-(p-toluenesulfonyl)-N'-(p-n-butylphenyl)urea,
N-(p-toluenesulfonyl)-N'-(o-chlorophenyl)urea,
N-(p-toluenesulfonyl )-N'-(m-chlorophenyl)urea,
N-(p-toluenesulfonyl)-N'-(2,4-dichlorophenyl)urea,
N-(p-toluenesulfonyl)-N'-benzylurea,
N-(p-toluenesulfonyl)-N'-(1-naphthyl)urea,
N-(p-toluenesulfonyl)-N'-{1-(2-methylnaphthyl)-}urea,
N-(benzenesulfonyl)-N'-phenylurea, N-(p-chlorobenzenesulfonyl)-N'-phenylurea,
N-(o-toluenesulfonyl)-N'-phenylurea,
N-(p-toluenesulfonyl)-N'-methylurea,
N-(p-toluenesulfonyl)-N'-ethylurea,
N-(p-toluenesulfonyl)-N'-(2-phenoxyethyl)urea,
N,N'-bis(p-toluenesulfonyl)urea,
N-(p-toluenesulfonyl)-N'-(o-diphenyl)urea,
N-(p-toluenesulfonyl)-N'-(p-ethoxycarbonylphenyl-)urea,
N-(p-toluenesulfonyl)-N'-butylurea,
N-(p-chlorobenzenesulfonyl)-N'-propylurea, and
N-(p-methoxybenzenesulfonyl)-N'-phenylurea.

3. The thermosensitive recording material as claimed in claim 1, wherein the color-developing aromatic compound having, per molecule thereof, two or more arylsulfonylureido groups of the formula (I) is selected from the group consisting of:

bis{N'-(p-toluenesulfonyl)ureido}ketone,
1,2-bis{N'-(p-toluenesulfonyl)ureido}ethane,
1,1,6,6-tetra{N'-(p-toluenesulfonyl)ureido}heptane,
1,5-bis{N'-(p-toluenesulfonyl)ureido}-3-oxapentane,
1,5-bis{N'-(p-toluenesulfonyl)ureido}-3-thiopentane,
1,3-bis{N'-(p-toluenesulfonyl)ureido}-2-propanone,
1,5-bis{N'-(p-toluenesulfonyl)ureido}-3-[2'-{N'-(p-toluenesulfonyl)ureido}ethyl]-3-ozapentane,
1,3-bis{N'-(p-toluenesulfonyl)ureido-N-methyl}benzene,
1,4-bis{N'-(p-toluenesulfonyl)ureido-N-methyl}benzene,
4,4'-bis{N'-(p-toluenesulfonyl)ureido}diphenylmethane,
4,4'-bis{N-(o-toluenesulfonyl)ureido}diphenylmethane,
4,4'-bis(benzenesulfonylureido)diphenylmethane,
4,4'-bis(1-naphthalenesulfonylureido)diphenylmethane,
2,2-bis[4',4''-{N'-(p-toluenesulfonyl)ureido}phenyl]-propane,
1,2-bis[4'-{N'-(p-toluenesulfonyl)ureido}phenyloxy]ethane,
2,5-bis[{N'-(p-toluenesulfonyl)ureido}methyl]furan,
1,3-bis{N'-(p-toluenesulfonyl)ureido}benzene,
1,4-bis{N'-(p-toluenesulfonyl)ureido}benzene,
1,5-bis{N'-(p-toluenesulfonyl)ureido}naphthalene,
1,8-bis{N'-(p-toluenesulfonyl)ureido}naphthalene,
4,4'-bis{N'-(p-toluenesulfonyl)ureido}diphenylether,
3,3'-bis{N'-(p-toluenesulfonyl)ureido}diphenylsulfone,
4,4'-bis{N'-(p-toluenesulfonyl)ureido}diphenylsulfone,
2,4-bis{N'-(p-toluenesulfonyl)ureido}toluene,
2,6-bis{N'-(p-toluenesulfonyl)ureido}toluene,
4,4'-bis{N'-(p-toluenesulfonyl)ureido}diphenylsulfide, and
3,4'-bis{N'-(p-toluenesulfonyl)ureido}diphenylether.

4. The thermosensitive recording material as claimed in claim 1, wherein the color-developing aromatic compound having, per molecule thereof, at least one arylsulonylureido group of the formula (I), is present in an amount of 5 to 50% by weight based on the total weight of the colored image-forming layer.

5. The thermosensible recording material as claimed in claim 1, wherein the sensitizing aromatic amide compound of the formula (II) has a melting temperature of 60° to 180° C.

6. The thermosensitive recording material as claimed in claim 1, wherein the sensitizing aromatic amide compound of the formula (II) is selected from the group consisting of:

benzanilide,
2-methyl-benzanilide,
benz-m-toluidide,
benz-p-toluidide,
benz-o-toluidide,
benz-o-anisidide,
benz-p-anisidide,
4-methyl-benz-o-anisidide,
benz-p-phenetidide,
benz-o-phenetidide,
benz-2'-chloroanilide,
benz-3'-chloroanilide,
benz-4'-chloroanilide,
4-methyl-benz-3'-chloroanilide,
3-methyl-benz-4'-chloroanilide,
3-methyl-benz-3'-chloroanilide,
4-methyl-benz-3'-trifluoromethylanilide,
3-methyl-benz-3'-trifluoromethylanilide,
benz-3'-trifluoromethylanilide,
3-bromobenz-o-anisidide,
4-nitrobenz-o-anisidide,
3-nitrobenz-m-anisidide,
benz-3'-methyl-o-anisidide,
benz-4'-chloro-5'-methyl-o-anisidide,
benz-5'-methyl-4'-nitro-o-anisidide,
benz-2'-4'-dimethoxyanilide,
benz-4'-chloro-p-phenetidide,
benz-5'-methyl-4'-nitro-o-phenetidide,
benz-4'-chloro-2'-5'-diethoxyanilide,
benz-2'-chloro-p-toluidide,
4-chlorobenz-p-toluidide,
2-methylbenz-o-toluidide,
2,4,6-trimethylbenz-p-toluidide,
2,4,6-trimethylbenz-o-toluidide,
benz-4'-chloro-o-toluidide,
2-methylbenz-4'-chloro-o-toluidide,
2-chlorobenz-2'-chloroanilide,
α-naphtho-2'-chloroanilide,
2-chlorobenz-3'-chloroanilide,
2-chlorobenz-4'-chloroanilide,
2-methylbenz-4'-chloroanilide,
3,4-dimethylbenzanilide,
benz-2',3'-dimethylanilide,
benz-2'-5'-dimethylanilide,
benz-3',4'-dimethylanilide,
benz-2'-chloro-5'-phenoxyanilide,
3-dimethylaminobenzanilide,
2-phenylbenzanilide,
2-benzylbenzanilide, and
N-(1-naphthyl)benzamide.

7. The thermosensitive recording material as claimed in claim 1, wherein the sensitizing aromatic amide compound of the formula (II) is present in an amount of 5 to 50% by weight based on the total weight of the colored image-forming layer.

* * * * *